US008407979B1

(12) United States Patent
Hofer

(10) Patent No.: US 8,407,979 B1
(45) Date of Patent: Apr. 2, 2013

(54) MAGNETICALLY-CONFORMED, VARIABLE AREA DISCHARGE CHAMBER FOR HALL THRUSTER, AND METHOD

(75) Inventor: Richard R. Hofer, Monrovia, CA (US)

(73) Assignee: The United States of America as Represented by the Administrator of the National Aeronautics and Space Administration, Washington, DC (US)

( * ) Notice: Subject to any disclaimer, the term of this patent is extended or adjusted under 35 U.S.C. 154(b) by 1318 days.

(21) Appl. No.: 11/926,279

(22) Filed: Oct. 29, 2007

(51) Int. Cl.
*F03H 3/00* (2006.01)

(52) U.S. Cl. ..... 60/202

(58) Field of Classification Search ..... 60/204, 60/203.1, 200.1, 310, 376, 219, 202; 315/85, 315/11.81, 111.91, 111.61, 111.11; 313/359.1, 313/360.1, 361.1, 362.1, 363.1
See application file for complete search history.

(56) References Cited

U.S. PATENT DOCUMENTS

| | | | | |
|---|---|---|---|---|
| 4,548,033 | A | 10/1985 | Cann | |
| 4,577,461 | A | 3/1986 | Cann | |
| 5,218,271 | A | 6/1993 | Egorov et al. | |
| 5,359,258 | A | 10/1994 | Arkhipov et al. | |
| 5,475,354 | A | 12/1995 | Valentian et al. | |
| 5,519,991 | A | 5/1996 | Butler | |
| 5,581,155 | A | 12/1996 | Morozov et al. | |
| 5,751,113 | A | 5/1998 | Yashnov et al. | |
| 5,838,120 | A * | 11/1998 | Semenkin et al. | 315/505 |
| 5,845,880 | A | 12/1998 | Petrosov et al. | |
| 5,847,493 | A | 12/1998 | Yashnov et al. | |
| 6,075,321 | A | 6/2000 | Hruby | |
| 6,150,764 | A | 11/2000 | Hruby et al. | |
| 6,158,209 | A | 12/2000 | Latischev et al. | |
| 6,208,080 | B1 | 3/2001 | King et al. | |
| 6,215,124 | B1 | 4/2001 | King | |
| 6,279,314 | B1 | 8/2001 | Valentian et al. | |
| 6,449,941 | B1 | 9/2002 | Warboys et al. | |
| 6,612,105 | B1 | 9/2003 | Voigt et al. | |
| 6,777,862 | B2 | 8/2004 | Fisch et al. | |
| 6,960,888 | B1 | 11/2005 | Foster | |
| 6,982,520 | B1 | 1/2006 | de Grys | |
| 7,030,576 | B2 | 4/2006 | McVey et al. | |
| 7,164,227 | B2 | 1/2007 | de Grys | |
| 7,624,566 | B1 * | 12/2009 | Manzella et al. | 60/202 |

OTHER PUBLICATIONS

Hofer, Development and Characterization of High-Efficiency, High-Specific Impulse Xenon Hall Thrusters, Dissertation for The University of Michigan, 2004, Ann Arbor, Michigan.
Kim, Main Physical Features and Processes Determining the Performance of Stationary Plasma Thrusters, Journal of Propulsion and Power, vol. 14, No. 5, Sep.-Oct. 1998.
Zhurin et al., Review article, Physics of closed drift thrusters, Plasma Sources Sci. Technol. 8 (1999) R1—R20.
Raitses et al., Propellant Utilization in Hall Thrusters, Journal of Propulsion and Power, vol. 14, No. 2, Mar.-Apr. 1998.
Arhipov et al., Numerical Research of Dynamics of Stream in the Stationary Plasma Thruster Channel of a Variable Section, American Institute of Aeronautics and Astronautics, AIAA-98/3800, 1998.
Arhipov et al., Study of Plasma Dynamics in the Variable Section Channel of Stationary Plasma Thruster, Japan Society for Aeronautical and Space Sciences, IEPC-99-118, 1999.
Design of the H6 Hall Thruster for High Thrust/Power Investigation, May 2007, Not Published.

* cited by examiner

*Primary Examiner* — Phutthiwat Wongwian
*Assistant Examiner* — Vikansha Dwivedi
(74) *Attorney, Agent, or Firm* — Mark Homer

(57) ABSTRACT

The invention is a Hall thruster that incorporates a discharge chamber having a variable area channel including an ionization zone, a transition region, and an acceleration zone. The variable area channel is wider through the acceleration zone than through the ionization zone. An anode is located in a vicinity of the ionization zone and a cathode is located in a vicinity of the acceleration zone. The Hall thruster includes a magnetic circuit which is capable of forming a local magnetic field having a curvature within the transition region of the variable area channel whereby the transition region conforms to the curvature of the local magnetic field. The Hall thruster optimizes the ionization and acceleration efficiencies by the combined effects of the variable area channel and magnetic conformity.

23 Claims, 3 Drawing Sheets

MAGNETICALLY-CONFORMED, VARIABLE AREA DISCHARGE CHAMBER FOR HALL THRUSTER, AND METHOD

STATEMENT AS TO FEDERALLY-SPONSORED RESEARCH

The invention described herein was made in the performance of work under a NASA contract, and is subject to the provisions of Public Law 96-517 (U.S.C. 202) in which the Contractor has not elected to retain title.

FIELD OF THE INVENTION

The present teachings relate to a Hall thruster for the maneuvering of space assets. In particular, the present teachings relate to a Hall thruster including a discharge chamber having a variable cross-section channel which improves ionization and acceleration efficiencies resulting in a high-performance, long-life thruster.

BACKGROUND OF THE INVENTION

Hall thrusters are plasma propulsion devices that have found application on-board spacecraft for stationkeeping, orbit transfers, orbit raising, and interplanetary missions. A unique combination of thrust efficiency, thrust density, and specific impulse makes Hall thrusters qualified to fill such a varied array of missions. Hall thrusters typically operate between 50-60% efficiency, thrust densities of 1 mN/cm$^2$, and specific impulses of 1000-3000 s. Hall thrusters have been flying in space since the 1970s and American designed Hall thrusters began flying in 2006.

Hall thrusters produce thrust by ionizing a propellant, typically xenon, and accelerating the resulting ions by way of the application of crossed electric and magnetic fields. The discharge chamber used to produce the plasma in Hall thrusters has traditionally been employed as a constant cross-sectional area along its axial extent. Variable area discharge chambers have also been sporadically reported in literature but various deficiencies have limited the utility of such Hall thrusters.

An investigation of the dependence of propellant utilization on discharge chamber width was discussed in Raitses, et al., "Propellant Utilization in Hall Thrusters," *Journal of Propulsion and Power*, Vol. 14, No. 2, March-April 1998. In this study, the channel width of a low-power Hall thruster was decreased by 40-55% by using a ceramic spacer that was inserted on the outer wall of the channel. The ceramic spacer or insert extended from the midpoint of the axial span between the anode and the peak magnetic field. It was found that the ceramic spacer improved mass utilization and specific impulse while essentially leaving efficiency unchanged except at high current density where the ceramic spacer resulted in decreased efficiency. This work demonstrated how an asymmetric spacer or insert can form a variable channel cross-section and improve propellant utilization. However, the use of such an asymmetrical spacer or insert that did not conform to the local magnetic field and introduced radial asymmetries into the neutral distribution likely limited the realization of the full benefits of the variable chamber width.

To achieve high thrust-to-power operation with a Hall thruster requires operation at low discharge voltages, typically in the range of 100 V to 150 V. This is much less than the 300 V to 500 V range where Hall thrusters typically operate. At such low voltages, the ionization efficiency is significantly decreased because the electron temperature approximately scales with discharge voltage as follows: $T_e \sim 0.1\ V_d$. As a result, at 100 V the electron temperature is approximately only 10 eV which is on the order of the first ionization potential of xenon, 12.1 eV. Therefore, such a low electron temperature leads to poor ionization efficiency, ultimately limiting the thrust-to-power ratio that can be achieved with the Hall thruster.

Accordingly, there exists a need for a Hall thruster that can provide a relatively high ionization efficiency at low discharge voltages thereby achieving a high thrust-to-power ratio at high efficiency. There also exists a need for a Hall thruster that can provide a relatively high ionization efficiency at high discharge voltages.

SUMMARY OF THE INVENTION

The present teachings provide a Hall thruster that can achieve a high thrust-to-power ratio at low discharge voltages. The Hall thruster includes a discharge chamber including a first end and a second end. An anode is located at the first end of the discharge chamber and a cathode is located at the second end of the discharge chamber. A magnetic circuit is capable of forming a magnetic field in the discharge chamber. The discharge chamber incorporates a variable area cross-section channel forming a diverging nozzle shape in a direction from the first end to the second end of the discharge chamber.

The present teachings further describe a Hall thruster including a discharge chamber including a variable area channel including an ionization zone, a transition region, and an acceleration zone. The variable area channel is wider through the acceleration zone than through the ionization zone. An anode is located in a vicinity of the ionization zone. A cathode is located in a vicinity of the acceleration zone. A magnetic circuit is capable of forming a local magnetic field having a curvature within the transition region of the variable area channel whereby the transition region of the variable area channel conforms to the curvature of the local magnetic field.

The present teachings still further describe a Hall thruster including a discharge chamber forming a diverging nozzle in a direction from a first end of the discharge chamber to a wider, second end of the discharge chamber. An anode is located in a vicinity of the first end of the discharge chamber. A cathode is located in a vicinity of the second end of the discharge chamber. A magnetic circuit is capable of forming a magnetic field in the discharge chamber such that a portion of the diverging nozzle of the discharge chamber is arranged to conform to a portion of the magnetic field.

The present teachings also describe a method of operating a Hall thruster with a high thrust-to-power ratio at relatively low discharge voltages. The method includes providing a discharge chamber including a variable area channel including an ionization zone, a transition region, and an acceleration zone, whereby the variable area channel is wider through the acceleration zone and narrower through the ionization zone. The method further includes forming a magnetic field within the discharge chamber having a converging plasma lens configuration whereby the transition region conforms to a curvature of a local magnetic field. The method further includes introducing a propellant into the narrower ionization zone of the discharge chamber, introducing electrons into the acceleration zone of the discharge chamber, and applying a potential difference between an anode and a cathode to produce an electric field in the discharge chamber.

Additional features and advantages of various embodiments will be set forth, in part, in the description that follows, and will, in part, be apparent from the description, or may be learned by the practice of various embodiments. The objectives and other advantages of various embodiments will be realized and attained by means of the elements and combinations particularly pointed out in the description herein.

It is to be understood that both the foregoing general description and the following detailed description are exemplary and explanatory only, and are intended to provide an explanation of various embodiments of the present teachings.

DETAILED DESCRIPTION OF THE PREFERRED EMBODIMENTS

The present teachings are directed to a Hall thruster that incorporates a variable cross-section channel with boundaries that are conformed to the local magnetic field curvature. This configuration significantly improves the ionization and acceleration efficiencies of the Hall thruster resulting in a relatively high thrust-to-power capability and a high-performance, long-life Hall thruster. The Hall thruster of the present teachings can be incorporated in Earth-orbiting and interplanetary applications.

Figure 1A:
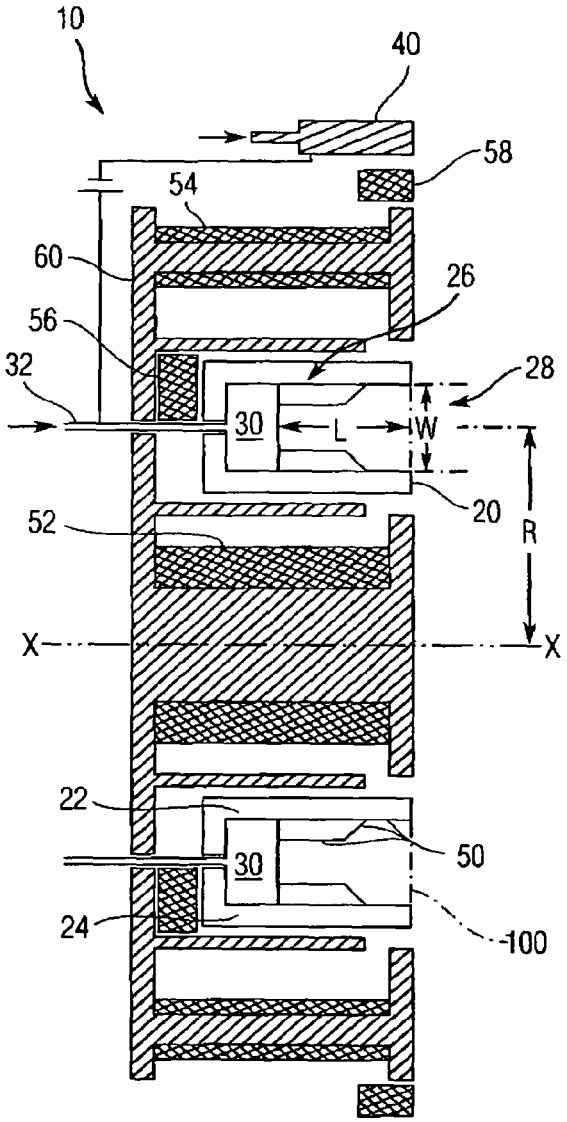
FIG. 1A is a schematic cross-sectional diagram of a Hall thruster including an externally mounted cathode according to various embodiments of the present teachings.
Figure 1B:
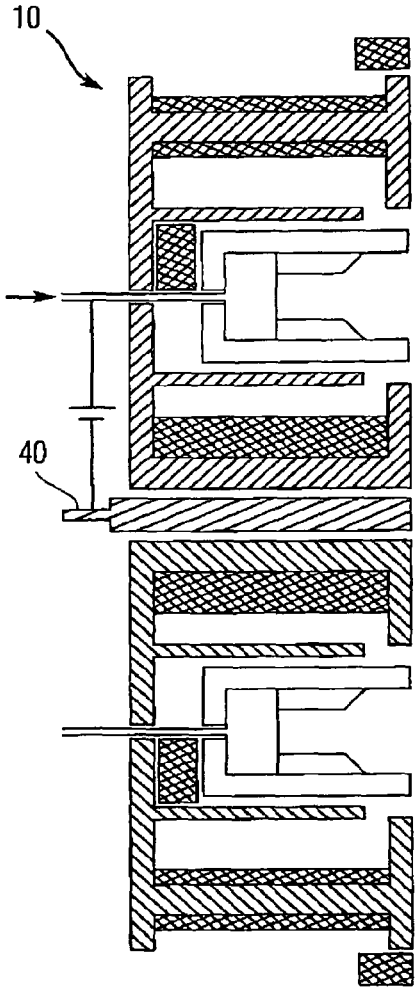
FIG. 1B is a schematic cross-sectional diagram of a Hall thruster including an internally mounted cathode according to various embodiments of the present teachings.

Referring now to FIG. 1A, the Hall thruster 10 is generally symmetrical about a thruster centerline axis X-X. The Hall thruster 10 includes four major components: a discharge chamber 20, an anode 30, a cathode 40, and a magnetic circuit 60. FIG. 1B shows the Hall thruster 10 with an internally mounted cathode 40 with the rest of the structure being substantially identical to the device shown in FIG. 1A.

The discharge chamber 20 can be a coaxial, annular chamber that is defined between an inner wall 22 and an outer wall 24. The inner and outer walls 22, 24 can be made preferably of a ceramic material. The annular discharge chamber 20 extends from a closed, upstream end to an open, downstream end. The width, W, of the discharge chamber 20 can be much less than the average radius, R, as measured from the thruster center line axis X—X to the center of the discharge chamber 20. This average radius of the discharge chamber 20 is defined as, $R=(R_{out}+R_{in})/2$, where $R_{out}$ is the radius of the outer wall 24 and $R_{in}$ is the radius of the inner wall 22, where $R_{out}$ and $R_{in}$ are defined on the "plasma" side of the discharge chamber 20, that is the surfaces where the plasma discharge is located.

The walls 22, 24 of the discharge chamber 20 are typically made from boron nitride (BN) or are mixed with silicon dioxide ($SiO_2$) into a compound called borosil ($BNSiO_2$). Other discharge chamber wall materials include alumina ($Al_2O_3$) or silicon carbide (SiC) which exhibit lower erosion under ion bombardment than boron nitride but their secondary electron emission characteristics result in enhanced electron transport that lowers thruster efficiency.

An anode 30 is arranged at the upstream end of the discharge chamber 20. To supply a positive potential to the anode 30, an electrical connection (not shown) is provided. The anode 30 can be circular and can include a feed tube 32 that delivers a propellant, such as, for example, xenon gas, into the discharge chamber 20. Alternatively, the anode 30 can be arranged to deliver krypton or argon gas, for example, into the discharge chamber 20. The anode 30 can be fabricated to ensure that the azimuthal distribution of the propellant gas is uniform. This can be accomplished through a series of equally spaced injection ports around the circumference of the anode 30. Moreover, baffles (not shown) may be supplied inside the anode 30 in order to improve distribution of the propellant gas around the discharge chamber 20. According to various embodiments, the anode and the gas distributor can be provided as separate components.

As shown in FIG. 1A, a cathode 40 can be mounted in the vicinity of the downstream end of the discharge chamber 20. The cathode 40 supplies electrons to the discharge chamber 20 for ionization and to the plume for neutralization of the ion exhaust. According to various embodiments, emitting filaments can be implemented in place of a cathode but an orificed hollow cathode 40 is the preferred source of electrons. In hollow cathodes, additional propellant gas is passed over a thermionic emitter, such as lanthanum hexaboride ($LaB_6$) or porous tungsten impregnated with oxides (e.g., barium oxide (BaO)), which when heated emits electrons and initiates a plasma breakdown via electron-neutral collisions. Electrons are extracted through a small orifice using a positively biased electrode called a keeper. Other types of cathodes 40 can be implemented which are capable of heaterless and keeperless operation after initial plasma breakdown occurs. As shown in FIG. 1B, the cathode 40 can be mounted on the centerline of the Hall thruster 10 or externally thereto, such as radially beyond any outer coil or coils as shown in previously discussed FIG. 1A.

Figure 3:
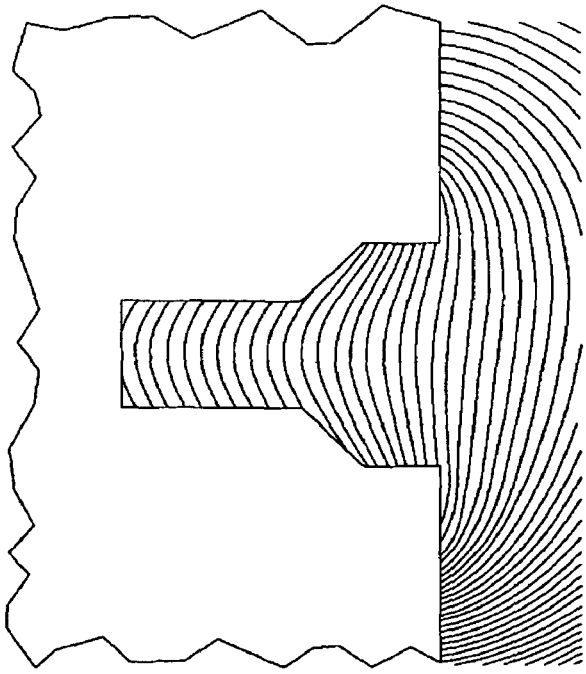
FIG. 3 shows the formation of a magnetic field that is shaped in a converging plasma lens configuration within the discharge chamber of the Hall thruster according to various embodiments of the present teachings.

The magnetic circuit 60 of the Hall thruster 10 supplies a magnetic field that confines the plasma in the discharge chamber 20 and acts as the support structure for other components of the Hall thruster 10. The magnetic circuit 60 can be composed of a collection of electromagnetic coils and magnetic pole pieces. The electromagnetic coils can be used to generate the magnetic flux and the magnetic pole pieces can be used to channel the magnetic flux into the discharge chamber 20. For example, the magnetic circuit can utilize one or more inner coils 52, one or more outer coils 54, and one or more internal trim coils 56 or external trim coils 58. As will be more fully discussed below and as shown in FIG. 3, the magnetic circuit 60 of the present teachings can be used to create a magnetic field having a plasma lens configuration with symmetric, concave field lines. The magnetic circuit is capable of producing maximum magnetic fields on the order of 100-400 G on a centerline of the discharge chamber 20.

The basic operation of the Hall thruster 10 will now be discussed with reference to FIG. 1. The Hall thruster 10 is a cross-field plasma source in which an axial electric field and a radial magnetic field are used to confine electrons and accelerate ions. For purposes of stability, the axial gradient of the applied radial magnetic field is positive along the discharge chamber 20, with the minimum magnetic field at the anode 30 and the maximum at a channel exhaust 100 of the discharge chamber 20. The magnitude of the magnetic field near the channel exhaust 100 is sufficient to magnetize electrons and the cross-field configuration forces electrons to execute closed, azimuthal drifts, forming a Hall current.

Electrons emitted from the cathode 40 are divided into two streams. One stream of electrons is attracted into the discharge chamber 20 and towards the anode 30. Electrons migrating upstream from the negatively-biased cathode 40 towards the positively-biased anode 30 encounter the radial magnetic field. The magnitude of the magnetic field is sufficient to magnetize electrons such that their gyroradius is much less than the discharge chamber 20 width while the interaction of the axial component of the electric field and radial component of the magnetic field within the discharge chamber 20 causes the electrons to travel in a generally circumferential direction, which severely restricts the axial mobility of the electrons towards the anode 30 and increases the electron residence time in the discharge chamber 20. Accordingly, the electrons can be used to effectively ionize the neutral propellant that is injected through the anode 30 into the discharge chamber 20. Restricting the axial mobility of the electrons is also responsible for establishing a self-consistent electric field, which must rise sharply in the region of maximum magnetic field intensity in order to maintain current continuity. This means that the electric field profile can be approximated from the magnetic field profile. The portion of the discharge chamber 20 where the electron drill is greatest is sometimes referred to as the closed-drift region.

Due to their much greater mass, the positively-charged ions are unimpeded by the magnetic field and are accelerated by an electric field produced by the application of a potential difference between the anode 30 and the cathode 40 in order to produce thrust. Such an applied voltage can be in a range of about 100 V to about 1000 V, or more particularly, the applied voltage can be about 300 V, for example. Moreover, the mixture of electrons and ions in the closed-drift region results in a plasma that is electrically neutral.

By lowering the applied voltage to a range of between about 100 V to about 150 V at constant power, as occurs when operating the Hall thruster 10 at a lower specific impulse (e.g. approximately 1000 s), the Hall thruster 10 can be operated in a high thrust-to-power (T/P) mode. However, operation of the Hall thruster 10 within this relatively low discharge voltage range typically results in a drastic reduction in ionization efficiency, which in turn limits the maximum achievable T/P. More particularly, at discharge voltages in the range of about 100 V to about 150 V, the ionization efficiency (which depends on the electron temperature and particle densities) largely suffers due to a decrease in the electron temperature. This occurs because the maximum electron temperature in the discharge chamber of Hall thrusters roughly scales with the discharge voltage as follows: $T_e \sim 0.1\ V_d$. For discharge voltages in the range of about 100 V to about 150 V, this results in electron temperatures approaching the first ionization potential of xenon, which is 12.1 eV. As a result, the ionization efficiency is depressed and thruster efficiency decreases to about 25-35%. This operating condition can be referred to as 'incomplete ionization'.

Figure 2:
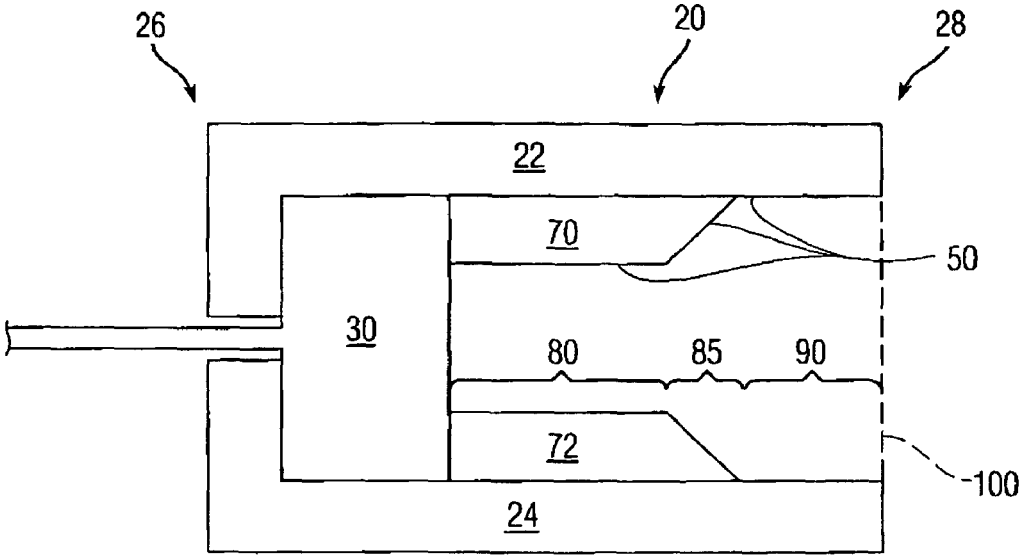
FIG. 2 is a close-up of a discharge chamber of the Hall thruster of FIGS. 1A and 1B.

To achieve high T/P operation at relatively low discharge voltages, the discharge chamber 20 of the Hall thruster 10 of the present teachings is incorporated with a variable area discharge channel 50. As shown in FIG. 2, the geometry of the variable area discharge channel 50 is achieved through the use of inserts 70, 72 that function to divide the discharge chamber 20 into a high-density ionization zone 80, a transition region 85, and a low-density acceleration zone 90. The inserts 70, 72 can be arranged to lock in place with each wall 22, 24, respectively, of the discharge chamber 20. Alternatively, the inserts 70, 72 can be integrally formed with each respective wall 22, 24 of the discharge chamber 20 to thereby form a solid, one-piece discharge chamber 20. The inserts 70, 72 are preferably made from boron nitride (BN) or are mixed with silicon dioxide ($SiO_2$) into a compound called borosil ($BNSiO_2$). Other materials can include alumina ($Al_2O_3$) or silicon carbide (SiC).

As will be more fully described below, the high-density ionization zone 80 operates to increase the ionization efficiency, the low-density acceleration zone 90 operates to increase acceleration efficiency and to decrease wall losses, and the transition region 85 smoothly connects the high-density ionization zone 80 with the low-density acceleration zone 90.

The variable area discharge chamber 20 can be provided with differing amounts of channel reduction. For example, referring to FIGS. 1 and 2, the inserts 70, 72 are shown reducing the width, W, of the discharge channel by 50%. According to various embodiments, other reductions in the channel width can be provided, such as, for example, in the range of about a 10% reduction to about a 70% reduction.

Moreover, as shown in FIG. 3, the transition region 85 of the variable area discharge channel 50 is arranged to conform to the local, magnetic field topography. Such an arrangement ensures that electron trajectories are not prematurely interrupted due to field line intersections with the walls of the discharge chamber 20. As will be discussed below, the magnetically-conformed, variable area discharge chamber 20 of the present teachings increases the ionization and acceleration efficiencies by way of the combined effects of the variable area shape of the discharge chamber and of magnetic conformity of the magnetic field with the transition region 85.

By varying the area or width of the discharge chamber 20, a diverging nozzle is formed thereby increasing the propellant density in the ionization zone 80 and proportionally improving the ionization efficiency. By forming a wider acceleration zone 90, the plasma is allowed to expand through the discharge chamber 20 and to exhaust out through the channel exhaust 100. This widening reduces ion losses to the walls of the discharge chamber 20, which decreases thermal, loads and sputtering of the walls that ultimately limits the life of the Hall thruster 10.

Referring again to FIG. 3, the transition region 85 incorporates a wall surface that is tangent to the local magnetic field lines. In both of the transition region 85 and the low-density acceleration zone 90, the magnetic circuit 60 of the Hall thruster 10 of the present teachings forms a magnetic field topography that is shaped in a converging plasma lens configuration characterized by symmetric, concave field lines. By conforming the wall surface of the transition region 85 to the magnetic field ensures that the electron currents traveling along magnetic field lines are not prematurely disrupted by the changing area of the walls of the discharge chamber 20.

The plasma lens configuration shown in FIG. 3 improves performance and thermal margin, decreases plume divergence and increases lifetime. These benefits are realized because, to an accuracy on the order of the electron temperature, magnetic field lines form equipotentials of the applied voltage. Thus, shaping the magnetic field such that the field lines are concave and symmetric across the discharge chamber 20 decreases the plasma flux to the wall while focusing the ions such that their radial velocity is minimized.

Figure 4A:
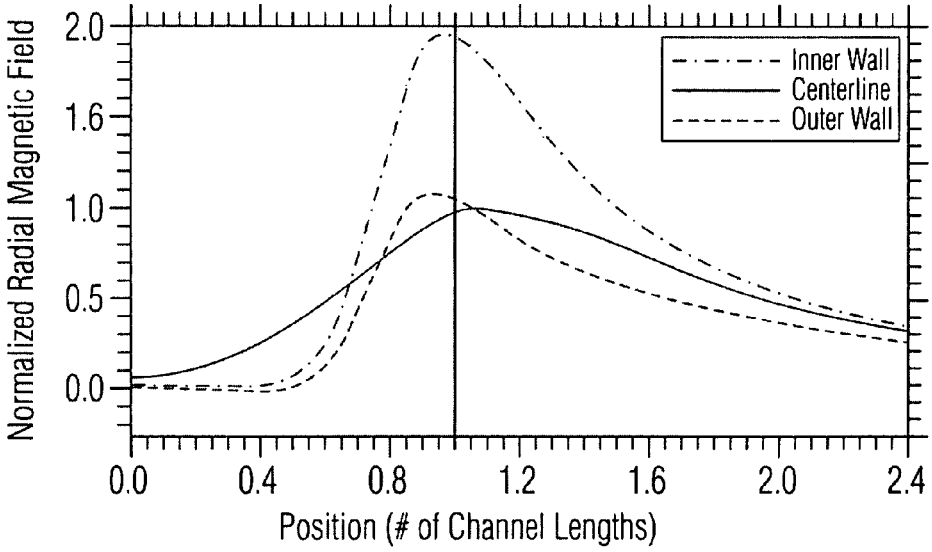
FIG. 4A is a graph showing radial magnetic fields along the centerline, inner, and outer walls of a Hall thruster discharge chamber.
Figure 4B:
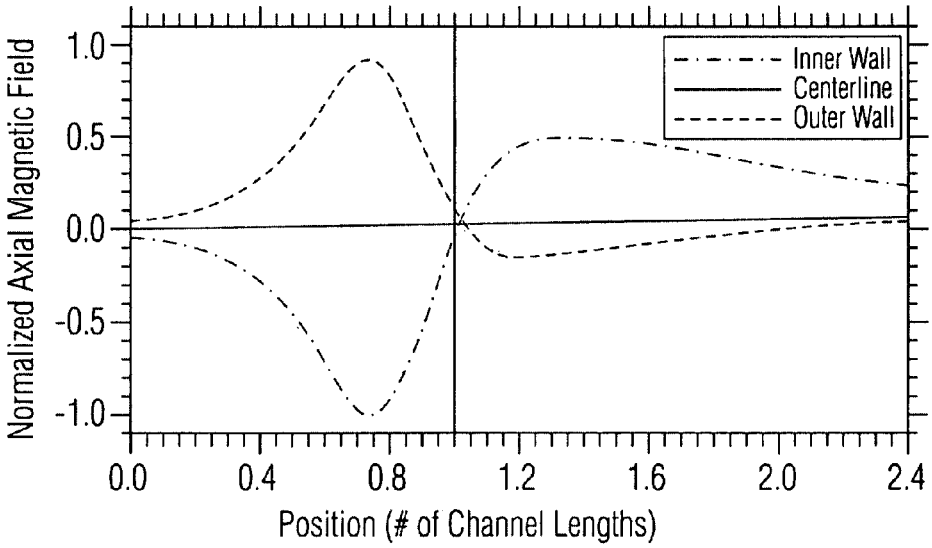
FIG. 4B is a graph showing axial magnetic fields along the centerline, inner, and outer walls of a Hall thruster discharge chamber.

FIGS. 4A and 4B show the axial variation of the radial and axial magnetic field components, respectively, along the outer wall 22, inner wall 24, and centerline of the discharge chamber 20. The profiles are characterized by a near zero axial magnetic field along the discharge chamber 20 centerline, a low magnetic field at the anode 30, and an axially increasing radial magnetic field that peaks near the exit of the discharge chamber 20. Additionally, at the discharge chamber walls the maximum radial fields are greater than the maximum value on channel centerline, that is, the mirror ratio along a magnetic field line is greater than unity. Such a configuration increases the magnetic insulation of the plasma from the walls because the plasma location tends towards regions of low magnetic field. Moreover, the field line curvature preferentially directs ions towards the channel centerline away from the walls, which increases efficiency and lifetime while decreasing plume divergence and thermal loads. This effect is greatest for ions born in weak electric fields before the ions are significantly accelerated. The plasma lens configuration also increases the path length (i.e., the residence time) of electrons trapped on a given field line thereby increasing the ionization efficiency and decreasing the axial electron current. Field lines terminating at the walls in regions of high magnetic field create a mirror effect on all but the most energetic electrons, reflecting the low-energy electrons back into the discharge chamber. The high-energy electrons penetrate both the magnetic field and the wall sheath potential and impact the walls, which in turn releases secondary electrons from the wall that decrease the average electron temperature in the channel.

The location of the transition zone 85 is important with respect to the proper operation of the magnetically-conformed, variable area discharge chamber 20 of the present teachings. The downstream boundary of the transition region 85 is chosen such that the magnetic field has reached about 80% of the maximum, centerline magnetic field strength ($B_{r,max}$) along the centerline of the discharge chamber 20. This location ($0.8*B_{r,max}$) roughly marks the separation between the ionization zone 80 and the acceleration zone 90 and can ensure that the benefits of the narrow area portion of the discharge chamber 20 are realized. This arrangement is shown graphically in FIGS. 4A and 4B for a variable area discharge chamber 20. As shown, in FIG. 4A, the plasma lens magnetic field topography can maintain a positive axial gradient of the centerline radial magnetic field over the length of the discharge chamber 20. The maximum centerline radial magnetic field ($B_{r,max}$) is downstream of the channel exhaust 100. The approximate separation between ionization and acceleration zones can occur at least about 80% of the length of the discharge chamber, measured from the face of the anode 30, i.e., at the centerline axial location where $B_r=0.8*B_{r,max}$. In addition to these locations of note, the ratio of $B_{r,max}$ along the walls to the centerline $B_{r,max}$ can be maximized to increase the magnetic mirror ratio for electron confinement. As shown in FIG. 4B, the axial magnetic field can be approximately zero along the channel centerline, and the field lines can be relatively flat near the anode 30.

As shown in FIG. 4A, the radial magnetic field reaches a minimum value of less than 10% of $B_{r,max}$ at the face of the anode 30. This design characteristic decreases the fall voltage in the anode sheath that is required to maintain current continuity. Optimum performance is achieved when the anode magnetic field strength is adjusted to zero. An internal trim coil 56 such as the one shown in FIG. 1 may be used for fine adjustment of the magnetic field intensity at the anode 30 as well as control of the axial gradient of the radial magnetic field.

According to various embodiments, the metal from the anode 30 can be extended axially down the length of the ionization zone 80, creating a region of constant potential. This configuration has the added advantage of further improvements in the acceleration efficiency. According to various embodiments, the anode and the gas distributor can be provided as separate components.

Those skilled in the art can appreciate from the foregoing description that the present teachings can be implemented in a variety of forms. Therefore, while these teachings have been described in connection with particular embodiments and examples thereof, the true scope of the present teachings should not be so limited. Various changes and modifications may be made without departing from the scope of the teachings herein.

What is claimed is:

1. A Hall thruster, comprising:

an annular discharge chamber including a first, closed end and a second, open end;

an anode located within and adjacent to the first end of the discharge chamber, having first and second ends, and a cathode located so as to provide a potential difference in the discharge chamber, creating an electric field; and a magnetic circuit capable of forming a magnetic field in the discharge chamber;

wherein the discharge chamber further comprises an ionization zone, a transition region, and an acceleration zone, each having a cross sectional area, the ionization zone adjacent to the second end of the anode and the acceleration zone adjacent to the second end of the discharge chamber, wherein the cross sectional area or the ionization zone is less than the cross sectional area of the transition region and the cross sectional area of the transition region is less than the cross sectional area of the acceleration zone.

2. The Hall thruster of claim 1, wherein the discharge chamber includes a relatively narrow ionization zone, a widening transition region, and a relatively wide acceleration zone.

3. The Hall thruster of claim 2, wherein the relatively narrow ionization zone and the relatively wide acceleration zone each include substantially constant cross-sectional areas.

4. The Hall thruster of claim 2, wherein the transition region includes a constantly increasing cross-sectional area.

5. The Hall thruster of claim 2, wherein the transition region includes a wall surface that is substantially tangent to magnetic field lines of the magnetic field formed in the discharge chamber.

6. The Hall thruster of claim 5, wherein the transition region includes a downstream boundary which is located where the magnetic field has reached about 80% of a peak, centerline magnetic field strength at an exhaust from the acceleration zone.

7. The Hall thruster of claim 1, wherein the ionization zone, transition region, and acceleration zone are formed by inserts arranged in the discharge chamber.

8. The Hall thruster of claim 1, wherein a portion of the discharge chamber conforms to the magnetic field formed in the discharge chamber.

9. The Hall thruster of claim 8, wherein the magnetic field is shaped in a converging plasma lens configuration.

10. A Hall thruster comprising:

An annular discharge chamber, having a first, closed end and an open second end, including an ionization zone, a transition region, and an acceleration zone, each having a cross sectional area, whereby the cross sectional area of the ionization zone is less than the cross sectional area of the transition region and the cross sectional area of the transition region is less than the cross sectional area of the acceleration zone;

an anode located within and adjacent to the first end of the discharge chamber, and adjacent to the ionization zone;

a cathode located so as to provide a potential difference in the discharge chamber, creating an electric field; and a magnetic circuit capable of forming a local magnetic field having a curvature within the transition region whereby the transition region conforms to the curvature of the local magnetic field.

11. The Hall thruster of claim 10, wherein the transition region of the variable area channel includes a wall surface that is tangent to the curvature of the local magnetic field.

12. The Hall thruster of claim 10, Wherein the ionization zone, the transition region, and the acceleration zone form a diverging nozzle.

13. The Hall thruster of claim 10, wherein the transition region includes a constantly increasing cross-sectional area.

14. The Hall thruster of claim 10, wherein the area of the channel through the ionization zone and the area of the channel through the acceleration zone each include substantially constant cross-sectional areas.

15. The Hall thruster of claim 14, wherein the area of the channel through the acceleration zone is about twice the area of the channel through the ionization zone.

16. The Hall thruster of claim 10, wherein the magnetic field is shaped in a converging plasma lens configuration.

17. A Hall thruster comprising:

An annular discharge chamber having a first, closed end and a second, open end of the discharge chamber, having an ionization zone, a transition region, and an acceleration zone therein, wherein a cross sectional area of the ionization zone is less than a cross sectional area of the transition region and a cross sectional area of the transition region is less than a cross sectional area of the acceleration zone;

an anode, within and adjacent to the first end of the discharge chamber, and a cathode located so as to provide potential difference in the discharge chamber so as to create an electric field; and a magnetic circuit capable of forming a magnetic field in the discharge chamber such that a portion of the discharge chamber is arranged to conform to a portion of the magnetic field.

18. The Hall thruster of claim 17, wherein the portion of the discharge chamber that is arranged to conform to the portion of the magnetic field includes a widening transition region arranged between a relatively narrow ionization zone and a relatively wide acceleration zone.

19. The Hall thruster of claim 18, wherein the widening transition region includes a downstream boundary which is located where the magnetic field has reached about 80% of a peak, centerline magnetic field strength at an exhaust from the discharge chamber.

20. The Hall thruster of claim 18, wherein the widening transition region includes a wall surface that is tangent to local magnetic field lines making up the portion of the magnetic field.

21. A method of operating a Hall thruster with a high thrust-to-power ratio at relatively low discharge voltages comprising:

Providing an annular discharge chamber having a first, closed end and a second, open end including an ionization zone, a transition region, and an acceleration zone, whereby the discharge chamber is wider through the acceleration zone and narrower through the ionization zone;

forming a magnetic field within the discharge chamber having a converging plasma lens configuration whereby the transition region conforms to a curvature of a local magnetic field;

introducing a propellant into the narrower ionization zone of the discharge chamber;

introducing electrons into the acceleration zone of the discharge chamber; and applying a potential difference between an anode, located within and adjacent to the first end of the discharge chamber, and a cathode to produce an electric field in the discharge chamber.

22. The method of claim 21, wherein applying a potential difference includes applying a potential difference in a range of between about 100 V to about 150 V.

23. The method of claim 21, wherein providing a discharge chamber includes introducing inserts into the discharge chamber to thereby form the ionization zone, the transition region, and the acceleration zone.

* * * * *